United States Patent [19]

Montalvo, Sr.

[11] 4,049,095

[45] Sept. 20, 1977

[54] MULTIPLE SPEED WEB REWIND TRANSMISSION IN SERIES WITH A SLIP COUPLING

[76] Inventor: Edwin J. Montalvo, Sr., 283 Anderson St., Hackensack, N.J. 07602

[21] Appl. No.: 577,949

[22] Filed: May 15, 1975

[51] Int. Cl.[2] ..... F16D 67/00

[52] U.S. Cl. ..... 192/3.51; 74/730; 192/48.3; 242/75.5; 254/187.7

[58] Field of Search ..... 192/3.51, 48.3; 74/730, 74/740, 756, 661; 242/196, 67.5, 75.5; 254/187 E, 187 F; 64/30 R; 310/95

[56] References Cited

U.S. PATENT DOCUMENTS

| | | | |
|---|---|---|---|
| 2,261,898 | 11/1941 | Barkeij | 74/740 X |
| 2,576,872 | 11/1951 | Young | 74/661 |
| 2,616,311 | 11/1952 | Lapsley | 74/730 |
| 2,796,222 | 6/1957 | Frankel | 242/75.5 |
| 3,318,167 | 5/1967 | Frost | 74/356 X |
| 3,584,250 | 6/1971 | Bottani | 310/105 |

FOREIGN PATENT DOCUMENTS

| | | | |
|---|---|---|---|
| 53,909 | 5/1934 | Norway | 64/30 R |

*Primary Examiner*—Benjamin W. Wyche
*Attorney, Agent, or Firm*—Brooks, Haidt, Haffner & Delahunty

[57] ABSTRACT

The rate of rotation of the shaft of a winding apparatus for webs of sheet material is controlled by means of a transmission system comprising a plurality of non-slip drive clutches arranged for successive engagement to provide stepwise reduction in the output speed of the system. The drive clutches are arranged to provide different ratios of speed reduction. As one drive clutch is disengaged, the next drive clutch is engaged and output speed is reduced. These drive clutches in turn drive the shaft of the winding apparatus through a slip clutch. The means for engaging and disengaging the drive clutches can be an automatic sensing device or a preset timer. The system can be used for winders, rewinders and unwinding apparatus.

8 Claims, 3 Drawing Figures

MULTIPLE SPEED WEB REWIND TRANSMISSION IN SERIES WITH A SLIP COUPLING

BACKGROUND OF THE INVENTION

1. Field of the Invention

The invention relates to a multiple speed transmission system, and more particularly to a transmission system for driving the shaft of a winding or unwinding apparatus to keep the surface speed and web tension of a roll being wound or unwound substantially constant while the roll diameter changes.

2. Description of the Prior Art

Various operations in the manufacture and processing of paper, film, foil and other flexible sheet materials in web form involve the winding, unwinding and rewinding of rolls of the web material. The maintenance of constant operating conditions requires that the surface speed and tension of the web be kept constant during unwinding winding and rewinding. To maintain constant surface speed and web tension as the diameter of a roll increases the drive speed of the core on which the material is being wound must be steadily reduced. The mass of the roll increases. Accordingly the drive to the core of a winder or rewinder requires some means for increasing torque output and reducing speed to maintain the tension in the material at a constant level while also keeping the surface speed constant.

These purposes can, or course, be achieved by use of a drive motor operating at varying speeds and producing varying torque. The motor-generator of "MG" drive can be effectively used for winding of web material. In such an MG drive an AC motor is used to drive a DC generator which in turn provides current to drive a variable torque, variable speed DC motor on the winder drive. Such systems are commercially available but very expensive.

In many cases it is more desirable to use a drive motor operating at constant speed. A constant speed motor can be used to drive a winding apparatus through a slip clutch or eddy current clutch, in which case the difference between the motor speed and the decreasing speed of rotation required for constant surface speed of material being wound must be speed lost in the clutch. Thus the slippage in a slip clutch used in such an arrangement would constantly increase as the roll goes from its small starting diameter to its final large diameter. The motion lost in the clutch can be considered as power absorbed and dissipated by the clutch. As used in this application, the term "slip clutch" refers to a clutch which permits slippage constantly during drive, not just upon engagement or under overload conditions.

The following example illustrates the great inefficiency of using a constant speed motor and a slip clutch to drive a rewind apparatus. In this example, paper, after processing, is wound on a core having a diameter of 3½ inches until a roll having a diameter of 60 inches has been wound. The surface speed of the paper web is maintained at 1000 feet per minute and the tension in the web is kept at 250 pounds to assure the formation of a uniform roll.

The speed of rotation of the drive shaft of the rewind device varies directly with the surface speed and inversely with the diameter of the roll. Since the surface speed is kept constant, the reduction in speed from beginning at a diameter of 3½ inches and ending at a full roll diameter of 60 inches entails a speed reduction ratio of 60/3.5 = 17.

Moreover, to provide the initial pull necessary to wind the first few turns of the web on the core means that the starting rate of rotation of the shaft must be about 10% greater than what would be required when only surface speed and diameter are taken into consideration. In the typical example given here, the initial drive speed of the shaft would be approximately 1200 RPM. When the roll reaches its full 60 inch diameter the speed of rotation to maintain the stated web tension will go down from 1200 RPM to only about 64 RPM.

If A is the core diameter, B is the full roll diameter, S the surface speed of the web material and P is the web tension, the following formulas show the power requirements in the example stated above. (Conversion factors are included to give the results in horsepower).

The power to pull the material is:

$$\frac{PS}{33000} = \frac{250 \times 1000}{33000} = 7.58 \text{ hp.}$$

The power absorbed by the slip clutch, including 10% initial slip (maximum), is:

$$\frac{PS}{33000}\left(\frac{11B}{10A} - 1\right) = \frac{250 \times 100}{33000}\left(\frac{11 \times 60}{10 \times 3\frac{1}{2}} + 1\right) = 135.2 \text{ hp.}$$

The maximum total power required for winding is:

$$\frac{PSB}{30000A} = \frac{250 \times 1000 \times 60}{30000 \times 3\frac{1}{2}} = 142.8$$

Comparison of these power requirements will clearly show the great amount of power wasted when a slip clutch alone is employed to produce the required reduction in speed.

Considering the high speeds, and the large size of the rolls handled in modern paper, film and foil processing, the amount of wasted power caused by inefficient roll drive systems is extremely great.

SUMMARY OF THE INVENTION

The transmission system of the present invention solves the problem of driving a winding apparatus at a steadily decreasing rate or rotation as the roll size increases while permitting use of a motor operating at constant speed. The invention avoids the waste of power entailed in the use of a conventional slip clutch or eddy current clutch, by stepwise reduction of drive speed. The transmission system of the invention will be seen to be useful not only for driving a winder or rewinder but also as an underdrive for an unwinding apparatus.

In accordance with the invention, a slip clutch or eddy current clutch on the drive shaft of a winding apparatus for web material does not have to absorb the entire difference between the drive speed output of a motor and the speed input required by the roll winding apparatus. Instead of wasting large amounts of power, speed is converted into torque by means of a plurality of non-slip drive clutches, engaged one after another between the motor and the slip clutch on the roll apparatus. Each of these drive clutches provides a greater ratio of speed reduction than the clutch previously engaged.

For example, when four drive clutches are employed in succession, the first clutch could be engaged while a roll builds up from an initial core diameter of 3½ inches to 7 inches. The first clutch is then disengaged and a second clutch further reduces speed as the roll grows from 7 inches to 14 inches. Then a third clutch takes over and the roll is wound to a diameter of 28 inches, and finally the fourth and final clutch provides the speed reduction required to bring the roll to its final diameter of 60 inches. It should be understood that the slippage required of the slip clutch on the shaft of the winding apparatus is limited to the output speed difference between the respective drive clutches. The slip clutch, by constant slippage, provides drive speeds intermediate between those provided by the non-slip clutches.

The foregoing example is for purposes of illustration only. Two, three, four or more drive clutches can be employed in a system according to the invention, and ratios between the output speeds and between the roll diameters at which the successive clutches operate can be chosen to provide the operating conditions desired in a given installation. Relatively inexpensive drive clutches can be employed since their primary function is simply to transmit torque upon engagement. Simple disc clutches can be employed as the drive clutches.

To interconnect the drive clutches with the motor and with the slip clutch on the winding apparatus shaft a gear train or belt drive can be used. In the case of a transmission with four drive clutches, the output shaft of the motor is arranged to drive each of the four clutches through a primary gear train or drive belt. Each of the respective drive clutches is equipped with a gear, pulley, or sprocket which imparts to the input side of the clutch a speed that is proportional to the ratio of the diameters of the driving and driven members. Each clutch in turn has an output shaft arranged, upon engagement of the clutch, to drive the winder through a slip clutch. Preferably the drive clutches are mounted so that their output shafts are in spaced parallel relationship.

The function of the slip clutch is thus only to absorb, by continuous slippage the limited speed difference between the beginning and end of the operation of each of the successive drive clutches.

more drive clutches are employed the steps between the successive ratios will be smaller and less power will be lost in the slip clutch. The choice of the number of drive clutches depends on a balancing of performance against the costs of power and equipment.

The successive engagement and disengagement of the respective drive clutches is preferably automatically controlled. Automatic control can be provided through the use of sensing means responsive to the diameter of the roll, or even by automatic timers, since the rate of winding in a given application is predetermined.

To smooth out the effect of changing ratios in stepping from one drive clutch to the next, it is preferable to provide means for gradually engaging each clutch. Thus if, as is currently preferred, the drive clutches are of the pneumatically actuated type, an air flow control valve can be provided for each drive clutch to eliminate sharp speed changes upon engagement and to maintain constant tension on the web.

Besides being useful in winding and rewinding of sheet material, the transmission system of the invention can be effectively utilized in conjunction with an unwinding apparatus to provide the torque requirements for unwinding the very large and heavy rolls that are now commonly handled.

These and other advantages and features of the transmission system of the invention will be more fully understood from the following detailed description of preferred embodiments of the invention, especially when that description is read in conjunction with the accompanying figures of the drawing.

DETAILED DESCRIPTION OF PREFERRED EMBODIMENTS

Figure 1:
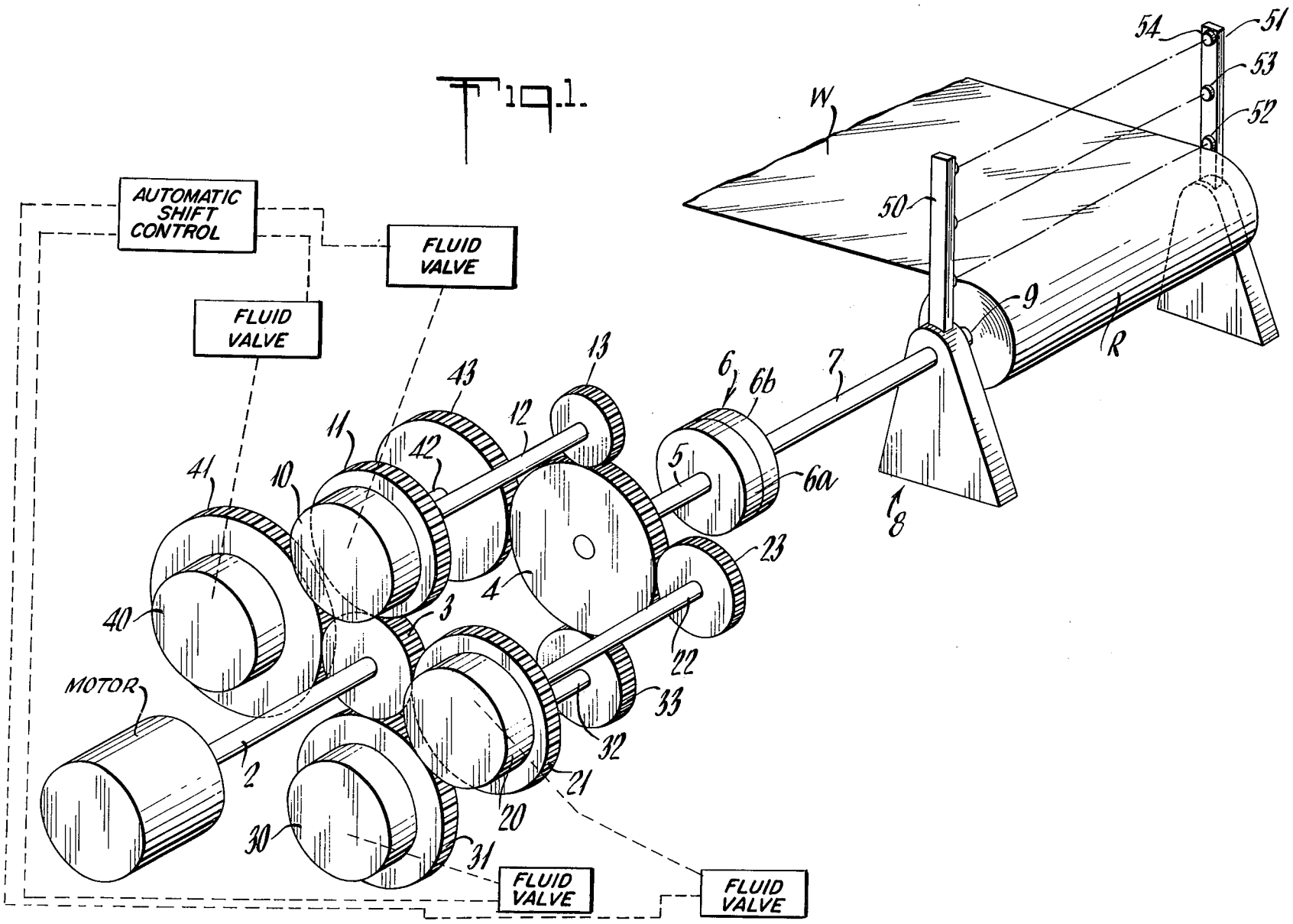
FIG. 1 is a somewhat schematic view of a geared transmission system according to the invention in combination with a motor and a rewinder.
Figure 2:
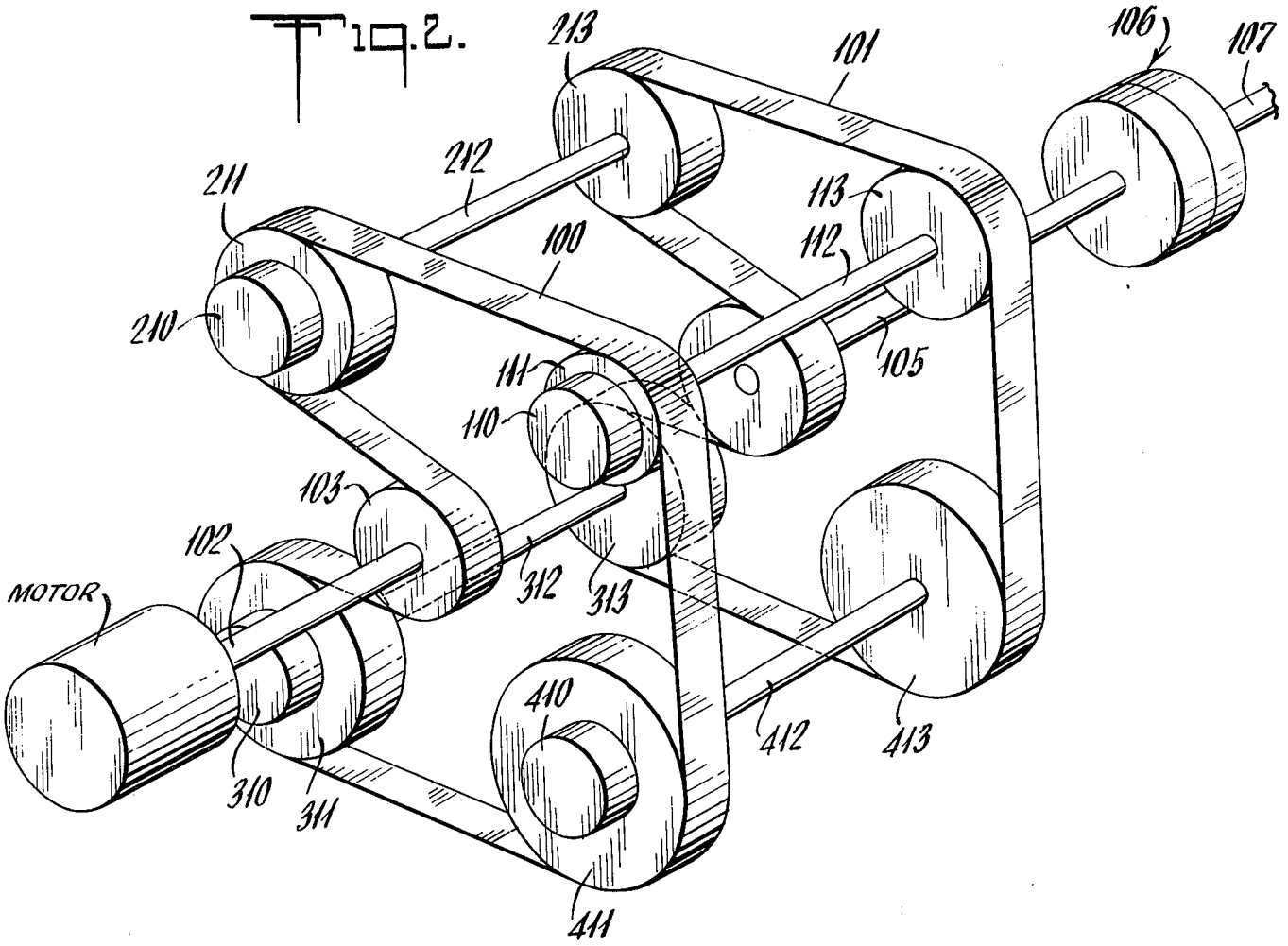
FIG. 2 is a modified form of the transmission system of the invention employing a belt drive.

In FIG. 1, a motor, which can be standard fixed speed AC motor, serves as the prime mover to wind a web W of sheet material into a roll R on a rewind stand generally indicated by reference numeral 8. The fact that a relatively inexpensive fixed speed motor can be employed is one advantage of the transmission system of the invention, shown in FIG. 1 as employing a gear train to achieve speed reduction. FIG. 2 shows another embodiment of the invention that uses a belt drive and pulleys for speed reduction. These two embodiments are illustrative of the fact that the transmission system of the invention can utilize different arrangements for transferring rotational motion from one element to another. Other possible arrangements could employ V-belts, timing belts or chains, gears, pulleys or sprockets, or combinations of different drive arrangements such as a primary gear train followed by belt drives.

The motor operates at constant speed, but as the roll R increases in diameter the web W would be under constantly increasing tension if the roll R were rotating at a constant angular velocity. The arrangement of drive clutches 10, 20, 30 and 40 with their associated equipment serve to transmit motion of the motor shaft 2 to the drive shaft 7 of the rewind stand 8 at a steadily decreasing speed and increasing torque. The drive clutches 110, 210, 310 and 410 of FIG. 2 and the elements associated therewith perform the same function as the similar drive clutches 10, 20, 30 and 40 of FIG. 1.

Referring more particularly to FIG. 1, it will be seen that the output shaft 2 of the motor terminates in an input gear 3. The input gear 3 is mounted in driving relationships with four "clutch" gears 11, 21, 31 and 41 of different sizes. These clutch gears do not touch each other and thus are able to rotate freely under the influence of the input gear 3. Each of the clutch gears 11, 21, 31 and 41 is mounted on the input element of one of four drive clutches 10, 20, 30 and 40 respectively. The drive clutches need not be described in detail since these can be simple, commercially available positive, non-slip clutches for transmitting rotational motion from an input element to an output member when engaged. When disengaged the input member of each of the clutches 10, 20, 30 and 40 rotates freely.

Each drive clutch has an axially extending intermediate output shaft which terminates in a gear. Thus the drive clutch 10, when engaged, transmits rotational motion from its clutch gear 11 to its output shaft 12 and thence to the gear 13. Drive clutch 20 has the clutch gear 21, output shaft 22, and the gear 23 on the output shaft 22. A similar reference number system has been used for the clutches 30 and 40 with their associated elements 31, 32 and 33 and 41, 42 and 43 respectively.

The gears 13, 23, 33 and 43 are mounted in driving relationship with a gear 4. Depending upon which of the drive clutches 10, 20, 30 or 40 is engaged, the gear 13, 23, 33 or 43 associated with the engaged clutch will drive the gear 4 at a rate that depends upon the speed reduction ratios afforded by the sizes of the gears associated with the engaged clutch. Thus engagement of clutch 10 with its relatively small gears 11 and 13 will drive the gear 4 faster than will engagement of clutch 20; clutch 20 and its associated gears 21 and 23 will drive the gear 4 at a faster speed than will clutch 30 and so on.

The gear 4 is keyed to an axially extending shaft 5 which is mounted to drive the input shaft 7 of the rewind stand 8 through a slip clutch 6. Thus the shaft 5 drives the input member **6*a* of the slip clutch 6, and the output member 6*b* of the slip clutch 6 drives the shaft 7**.

The slip clutch 6 need not be described in detail, since it can be of a commercially available type. The function of the slip clutch 6 is to permit the shaft 7 to rotate slower than the shaft 5. Thus the clutch 6 permits slippage as the speed of angular motion of the shaft 7 decreases with the increasing diameter of the roll R.

A friction clutch or eddy current clutch which dissipates absorbed power as heat can be used as the clutch 6. Those familiar with the performance of slip clutches will understand that the clutch 6 slips not only upon engagement, but because of its function heretofore described of constantly permitting the speed of angular motion of shaft 7 as the roll diameter 12 increases, slip clutch 6 permits continual slippage and dissipation of rotational speed.

The roll R is formed by winding of the web W on a core 9 of the rewind stand 8, and the core 9 is driven by the drive shaft 7. A brake (not shown in the drawing) can be provided to control the rotation of the roll R.

The operation of the transmission arrangement of FIG. 1 can be described with reference to the graph of FIG. 3 which illustrates two examples of winding operations. Two sets of curves for rolls of two different sizes wound at different speeds are illustrated in comparison to an "ideal" curve for each case. In both cases it will be seen that smoothly stepped curves I and II respectively approximate the smooth curve just below the stepped curve. The smooth curves show the relationship between the diameter of the roll (R in FIG. 1) and the speed of rotation of the winder drive shaft (7 in FIG. 1) required for constant surface speed and constant tension in the web being wound.

Figure 3:
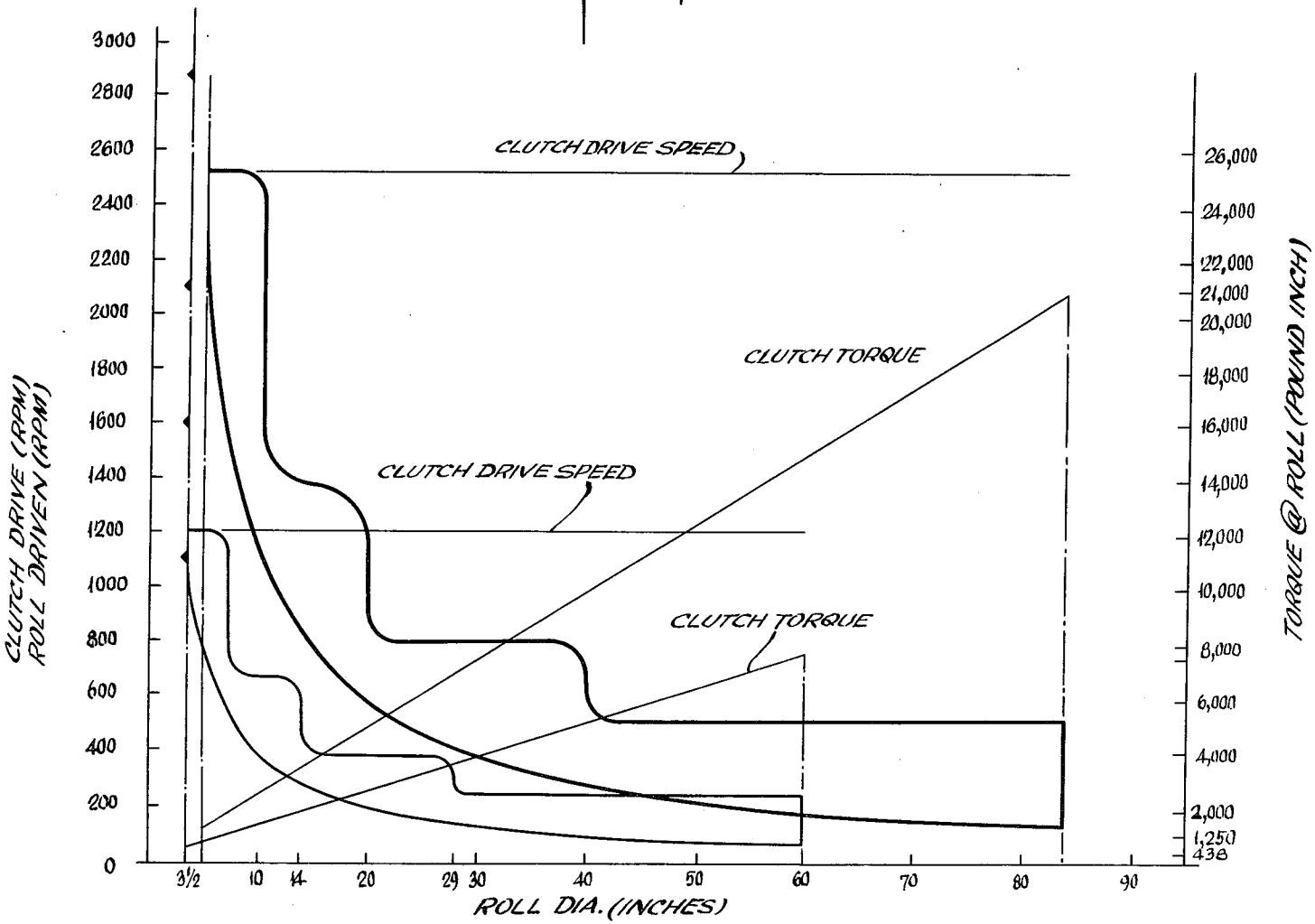
FIG. 3 is a graph illustrating relationship between drive speed, roll diameter and torque in two applications of the transmission system of the invention.

The curves shown in FIG. 3 are based on the following data:

| | Case I/ | Case II |
|---|---|---|
| Full Roll Diameter (inches) | 60 | 84 |
| Core Diameter (inches) | 3½ | 5 |
| Tension on Web (pounds) | 250 | 500 |
| Surface Speed of Web (feet/minute) | 1000 | 3000 |
| Speed of Motor (RPM) | 1200 | 2520 |
| Power to Pull Web (hp) | 7.57 | 45.5 |

It will be noted that the data for Case I correspond to the illustration of a prior art system set forth above in the Description of the Prior Art.

Each of the four steps of the stepped curves of FIG. 3 corresponds to the domain of one of the successively engaged clutches 10, 20, 30 and 40 illustrated in FIG. 1.

The operation illustrated in Case I of FIG. 3 proceeds as follows, with reference also to the system illustrated in FIG. 1. At the beginning of a winding operation a bare spool or core 9 is placed on the rewind stand 8 as shown in FIG. 1 and paper or other web material is wrapped manually around the core 9 preparatory to winding. The drive motor is then energized, and drive clutch 10 is engaged. This drives the shaft 7, by way of the intermediate shaft 12 and gears 13 and 4, at the maximum speed of 1200 RPM while the roll grows in diameter as shown by the level part of the topmost step at the left in FIG. 3, curve I. As shown by the smoothly declining curve below curve I the increase in roll size is accompanied by a decrease in the speed of rotation of the core 9 and shaft 7. The area between the stepped curve and the lower smooth curve represents the speed difference which is accommodated as slippage in the slip clutch 6.

When the roll R has reached a certain size the speed difference between the drive speed of 1200 RPM of clutch 10 and the speed of drive shaft 9 becomes appreciable. This speed difference is then cut down by the disengagement of clutch 10 and the simultaneous engagement of clutch 20, which drives at a slower speed, converting some motor speed into torque. This is seen as the first substantially vertical step down in curve I at a point where the roll diameter has doubled to 7 inches. Clutch 20, through the shaft 22 and gears 23 and 4 drives the shaft 5 of the slip clutch 6 at 665 RPM, much closer to the drive speed required by the shaft 9.

The second step down is shown to occur when the roll diameter has reached 14 inches. At that point, clutch 30 takes over, driving the shaft 5 at a speed of 380 RPM. Finally, clutch 30 is disengaged and clutch 40 is engaged when the roll diameter has reached 28 inches. Clutch 40, as illustrated in FIG. 3, is geared to drive at 240 RPM.

The horizontal line accross the graph at 1200 RPM is seen to be widely separated from the lower curve. The distance between the 1200 RPM line and the stepped curve I represents power saved through the use of the transmission system of the invention as compared to using a slip clutch or eddy current clutch alone.

Using the formula set forth above in the discussion of the prior art for calculating power required for winding, power used at each step can be computed as follows:

$$\text{Maximum power required} = \frac{PSB}{30000A}$$

Step 1, clutch 10:

$$\frac{250 \times 1000 \times 7}{30{,}000 \times 3\frac{1}{2}} = 16.67 \text{ hp}$$

Step 2, clutch 20:

$$\frac{250 \times 1000 \times 14}{30000 \times 7} = 16.67 \text{ hp}$$

Step 3, clutch 30:

$$\frac{250 \times 1000 \times 28}{30000 \times 14} = 16.67 \text{ hp}$$

Step 4, clutch 40:

$$\frac{250 \times 1000 \times 60}{30000 \times 28} = 17.83 \text{ hp.}$$

Comparison of these power requirements with the over 140 hp required when a slip or eddy current clutch alone is used will clearly show the advantages of the transmission of the present invention.

Curve II of FIG. 3, showing the winding of a bigger roll at a higher speed and tension shows the stepping down of drive speed from 2520 RPM to 1375 RPM, 800 RPM and finally 510 RPM, as the roll size increases past 10, 20 and 40 inches respectively.

It will be clear that if a greater number of drive clutches were used the stepped curves could be brought closer to the smooth curves with further power savings. In some applications where the power loss can be tolerated, fewer than four drive clutches can be used.

The steps shown in FIG. 3 have rounded "corners," because it is desirable to avoid sharp sudden changes in drive speed. In a presently particularly preferred embodiment of the invention, the drive clutches employed are pneumatic or pneumatic-hydraulic clutches equipped with regulating air valves for modulating the flow of actuating air to the clutches at the points where the transmission shifts from one clutch to the next. Such a modulation can be readily effected by known means in various embodiments of the invention whether or not the drive clutches are fluid actuated.

Reference is now made to FIG. 2 showing a belt drive arrangement which can be used to obtain the same results as the gear train of FIG. 1. In FIG. 2 drive clutches 110, 210, 310 and 410 correspond in nature and function to the clutches 10, 20, 30 and 40 of FIG. 1.

The motor in FIG. 2 through its output shaft 102 drives pulley 103. The pulley 103 is in driving relationship with the four clutch pulleys 111, 211, 311 and 411 through the belt 100.

As in the embodiment of FIG. 1, there are four sets of associated elements for successive operation. Thus drive clutch 110 is associated with the clutch pulley 111, intermediate shaft 112 and pulley 113 on shaft 112. Clutch 210 has clutch pulley 211, shaft 212 and pulley 213, and so on.

By means of the belt 101, each of the pulleys 113, 213, 313 and 413 is mounted to drive the pulley 104 when the respective clutch is engaged.

Just as in the gear train of FIG. 1, the relative diameters of the pulleys govern the ratio of reduction of speed from the motor shaft 102 to the shaft 105.

The slip clutch 106 corresponds to slip clutch 106 of FIG. 1 in structure and function, and the shaft 107 corresponds to shaft 7 in FIG. 1. The system of FIG. 2 will produce similar results to those of the transmission of FIG. 1 and the graph of FIG. 3 is also applicable to the belt driven arrangement.

Other arrangements for transferring motion between the elements of a transmission system, such as V-belts, chains and sprockets, etc., will suggest themselves to those acquainted with mechanics.

One automatic control arrangement for the transmission of the invention is shown in FIG. 1, wherein a pair of spaced, upstanding posts 50 and 51 are shown mounted on the rewind stand 8 at opposite ends of the roll R. The elements 52, 53 and 54 on post 51 are photoelectric cells, each of which is in paired spaced relationship with a beam source mounted on post 51, and the dashed lines illustrate beams passing parallel to the axis of roll R. As the roll grows in diameter it successively interrupts the beams to the cells 52–54, thereby closing a relay which actuates the shift from one drive clutch to the next. Such a control system can of course also be applied to the embodiment of FIG. 2. Other suitable control devices and systems for automatic actuation to engage and disengage the drive clutches will suggest themselves. For example, an automatic timer set to shift from one clutch to the next after preset time intervals could be used. Mechanical sensors of various types are possible.

The transmission system of the invention has been described in conjunction with a winder or rewinder for web material. The system is also useful as a underdrive for an unwinding device. In some operations very large and massive rolls of paper or other web material are unwound. Such rolls can weigh several tons and when they are rotated about their axes at high speeds, great angular momentum is developed. The conservation of such momentum as a roll is unwound causes a tendency to increase the speed of rotation. The tendency to increase in speed can be overcome by using a transmission system according to the invention.

What is claimed is:

1. A multiple speed transmission system for transferring rotary motion to apparatus of the type used in processing webs of sheet material comprising a plurality of positive non-slip clutches, each of said non-slip clutches being mechanically coupled to speed reducing means at the input side of each said non-slip clutch, the speed reducing means for each of said non-slip clutches providing a different ratio of speed reduction than that of the other non-slip clutches, means for successively engaging said non-slip clutches one at a time with drive means through said speed reducing means, each of said non-slip clutches having an output shaft mounted in driving relationship with an input shaft of a slip clutch constantly slipping during driving for driving said slip clutch at different rates of speed.

2. In combination, a motor, a plurality of non-slip clutches and a slip clutch which slips constantly during driving, means for driving input elements of said non-slip clutches at mutually different ratios with respect to the output speed of said motor, means for successively engaging said non-slip clutches one at a time, each of said non-slip clutches having an output shaft mounted in driving relationship with an input side of said slip clutch.

3. The combination of claim 2 wherein said motor is a constant speed motor.

4. The combination of claim 2 wherein a gear train is the means for driving the input elements of said non-slip clutches at said mutually different ratios.

5. The combination of claim 2 wherein belts and pulleys are the means for driving the input elements of said non-slip clutches.

6. The combination of claim 2 and including means for automatically shifting from one non-slip clutch to another non-slip clutch.

7. A drive for a rewind stand of the type used to wind a web of sheet material while maintaining constant surface speed and constant tension in said web comprising, a prime mover operative to drive an output shaft at constant speed, a plurality of non-slip clutches, means for successively engaging each of the non-slip clutches to drive said non-slip clutches at mutually different speeds with respect to the speed of said output shaft, means transmitting rotational motion from each of said non-slip clutches to an input side of a slip clutch which slip clutch slips constantly during driving, and an input shaft of said rewind stand arranged to be driven through said slip clutch.

8. The drive of claim 7 wherein said non-slip clutches are fluid actuated, a fluid valve for each of said non-slip clutches being operable upon engagement to modulate the action of the non-slip clutch.

* * * * *